US008016175B2

(12) United States Patent
Dvells, Jr.

(10) Patent No.: US 8,016,175 B2
(45) Date of Patent: Sep. 13, 2011

(54) ATTACHMENT FOR STITCHING TOOL

(76) Inventor: Walter E. Dvells, Jr., Worth, IL (US)

( * ) Notice: Subject to any disclaimer, the term of this patent is extended or adjusted under 35 U.S.C. 154(b) by 81 days.

(21) Appl. No.: 12/379,425

(22) Filed: Feb. 20, 2009

(65) Prior Publication Data

US 2009/0211774 A1 Aug. 27, 2009

Related U.S. Application Data

(60) Provisional application No. 61/064,266, filed on Feb. 25, 2008.

(51) Int. Cl.
*B27C 3/08* (2006.01)

(52) U.S. Cl. ..... 227/131; 227/107; 227/140; 227/156

(58) Field of Classification Search ..... 227/131, 227/107, 140, 156
See application file for complete search history.

(56) References Cited

U.S. PATENT DOCUMENTS 1,855,178 A * 4/1932 Bliss et al. ..... 227/131
2,656,537 A * 10/1953 Geel ..... 227/131
2,859,443 A * 11/1958 Jopp ..... 227/156
3,041,618 A * 7/1962 Ruskin et al. ..... 74/105
3,058,117 A * 10/1962 Moore ..... 227/7
3,282,489 A * 11/1966 March ..... 227/7
3,346,163 A * 10/1967 Manganaro ..... 227/131
3,531,036 A * 9/1970 Felson ..... 227/7
4,288,019 A * 9/1981 Dahle ..... 227/7
4,405,073 A * 9/1983 Salleras Escalante ..... 227/144
4,572,419 A * 2/1986 Klaus et al. ..... 227/120
4,589,581 A * 5/1986 Balma ..... 227/8
5,090,490 A 2/1992 Block
5,183,196 A * 2/1993 Miyashita ..... 227/7
5,240,162 A 8/1993 Block
5,447,263 A * 9/1995 Tropper et al. ..... 227/63
5,509,489 A 4/1996 Lower, Jr.
6,981,627 B2 * 1/2006 Tsai ..... 227/67
7,225,959 B2 6/2007 Patton et al.
2007/0023472 A1 2/2007 Schiestl
2008/0210735 A1 * 9/2008 Stratton ..... 227/155
* cited by examiner

*Primary Examiner* — Paul R. Durand
*Assistant Examiner* — Michelle Lopez
(74) *Attorney, Agent, or Firm* — Richard C. Litman

(57) ABSTRACT

The attachment for a stitching tool is an attachment that enables a manually operated stitching tool to convert to a power-operated stitching tool. The attachment includes an ergonomically designed handle mounted on a base, which base is provided with an opening at one end thereof. The opening is designed to receive the grasping portions of a manually operated, conventional stitching tool. Mechanisms in the base engage the grasping portions of the stitching tool to mechanically manipulate the grasping portions. The mechanisms are powered by an electric motor. Controls are provided on the handle for operating the electric motor.

4 Claims, 4 Drawing Sheets

ATTACHMENT FOR STITCHING TOOL

CROSS-REFERENCE TO RELATED APPLICATION

This application claims the benefit of U.S. Provisional Patent Application Ser. No. 61/064,266, filed Feb. 25, 2008.

BACKGROUND OF THE INVENTION

1. Field of the Invention

The present invention generally relates to handheld tools, and more particularly to an attachment for a stitching tool that converts a stitching tool from manual operation to power operation.

2. Description of the Related Art

Manually operated stitching tools are used by thousands of workers in various industrial applications (garment, carpet, etc.). The use of these tools requires repetitive motion that produces stress to the hand and arm of the worker and causes debilitating injuries such as muscle strain and carpel tunnel syndrome. Such injuries are painful, reduce worker efficiency and may result in worker disablement. The industry would certainly welcome an attachment for a stitching tool that would alleviate the strain-producing repetitive procedures and still permit manual operation when necessary. Thus, an attachment for a stitching tool solving the aforementioned problems is desired.

SUMMARY OF THE INVENTION

The attachment for a stitching tool converts a manual stitching tool to a power tool. The attachment includes an ergonomically designed handle mounted on a base. The base is provided with an opening at one end thereof. The opening is designed to receive the grasping portions of a manually operated, conventional stitching tool. Mechanisms in the base engage the grasping portions of the stitching tool to mechanically manipulate the grasping portions. The mechanisms are operated by an electric motor powered by a battery or, alternatively, an AC power source. Controls are provided on the handle for operating the powered mechanisms. The attachment can be fabricated from any suitable, durable material (preferably lightweight).

Accordingly, the invention presents an attachment for a conventional stitching tool that permits a user to convert the tool from a manually operated stitching tool to a powered stitching tool. The stitching tool remains fully portable in the power mode and can be reverted to a manual mode quickly and easily. Although the attachment is indicated for use with a stitching tool, it is obvious that other similar tools may be utilized. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
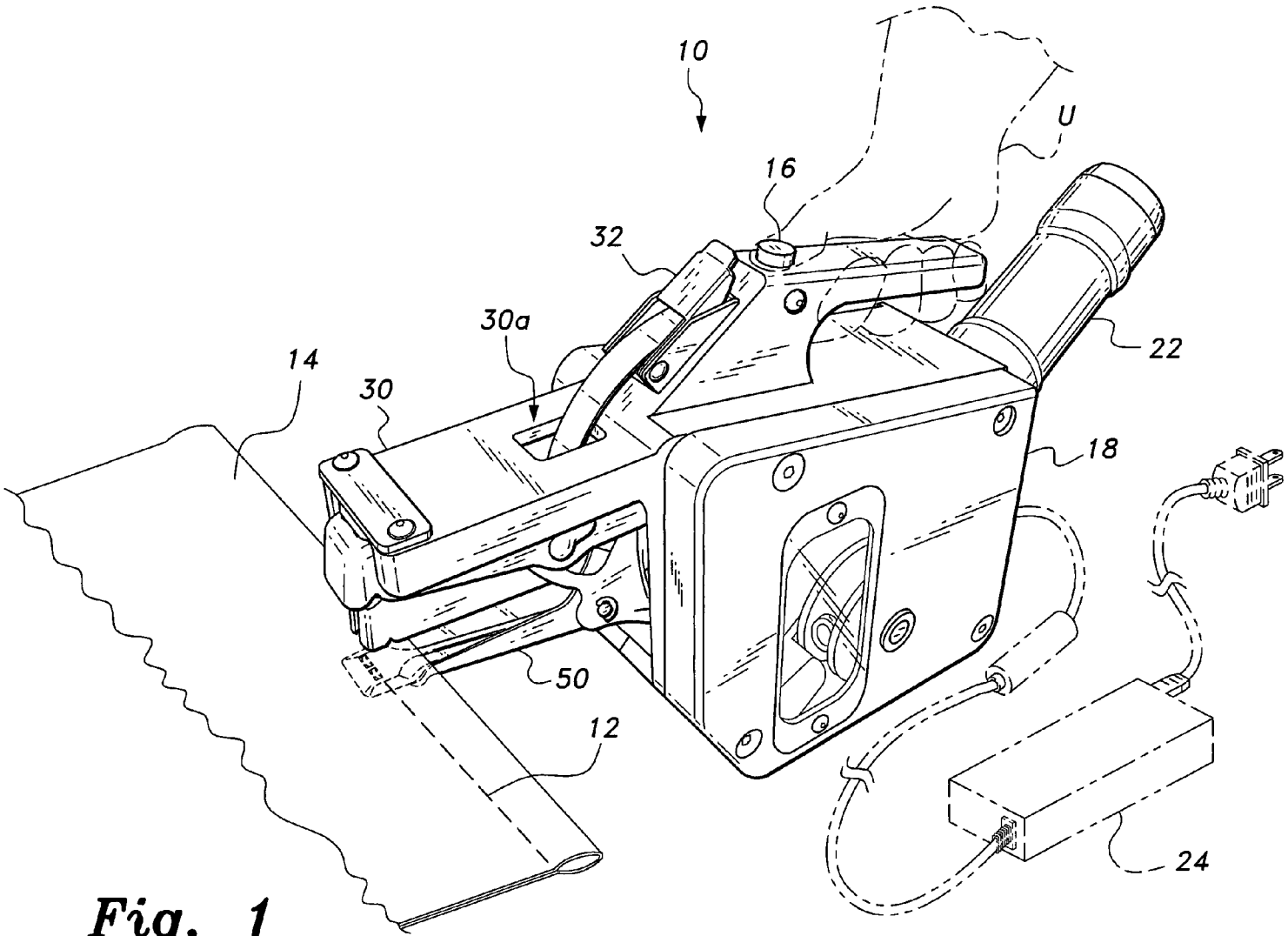
FIG. 1 is an environmental, perspective view of an attachment for a stitching tool according to the present invention.

As shown in FIG. 1, the attachment for a stitching tool, designated generally as 10 in the drawings, is shown in use with a conventional stitching tool 50 applying a staple/stitch 12 to a fabric 14. A user U is only required to manipulate a switch 16 to cause the tool to function. No repetitive hand motion is necessary.

Figure 2:
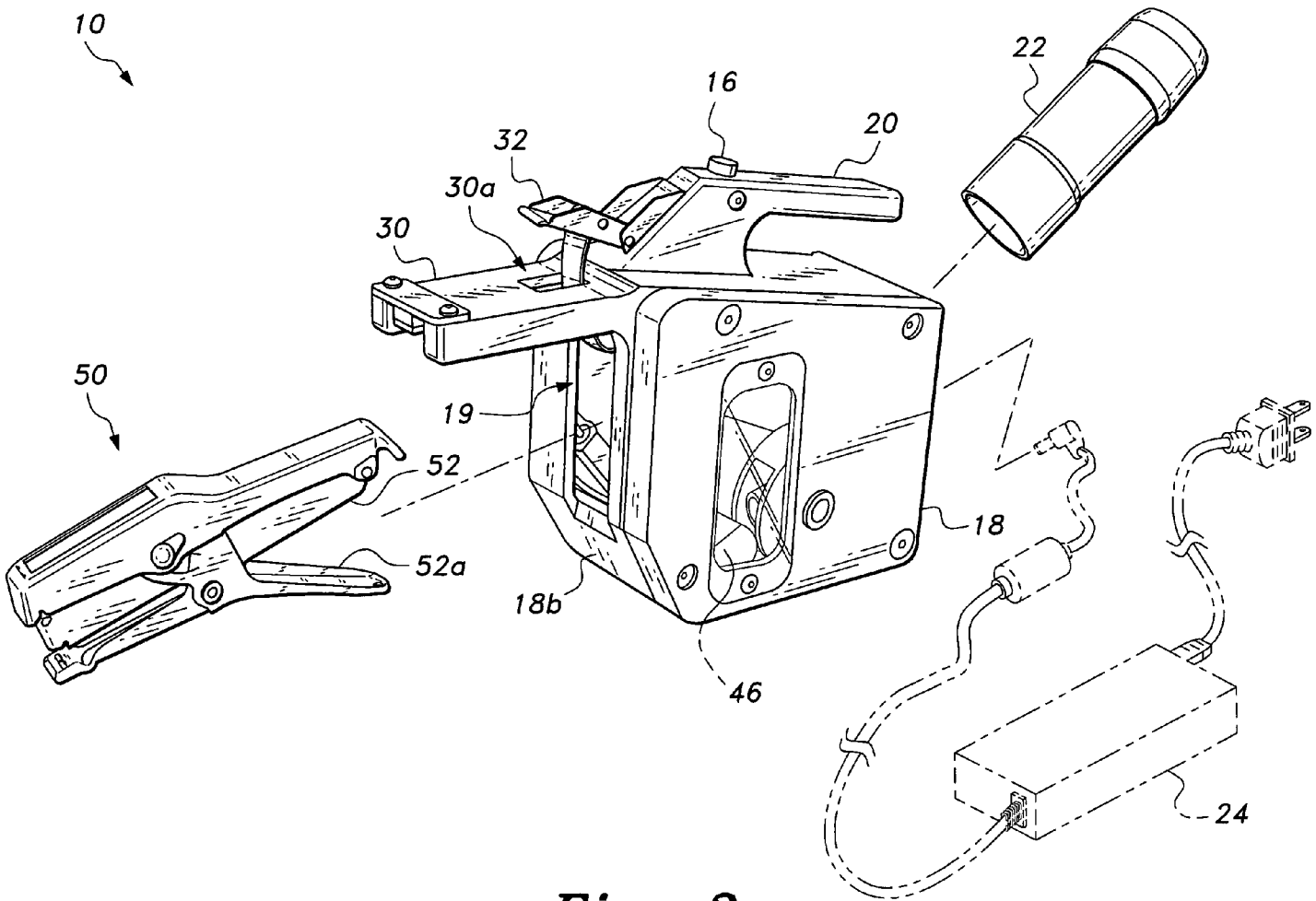
FIG. 2 is an exploded, perspective view of the attachment for a stitching tool according to the present invention.
Figure 3:
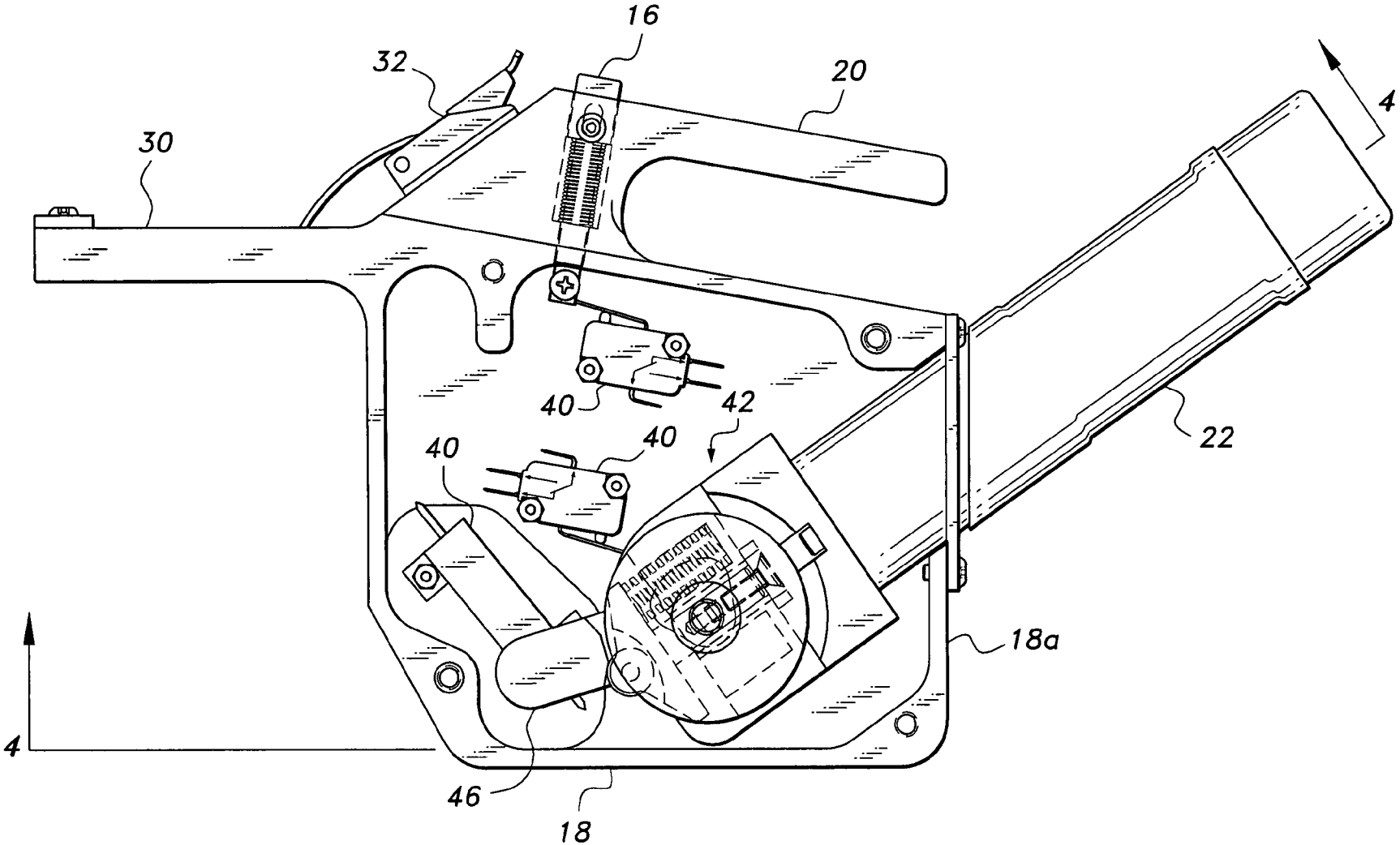
FIG. 3 is a side view of the attachment for a stitching tool according to the present invention, shown with the cover removed to show details thereof.
Figure 4:
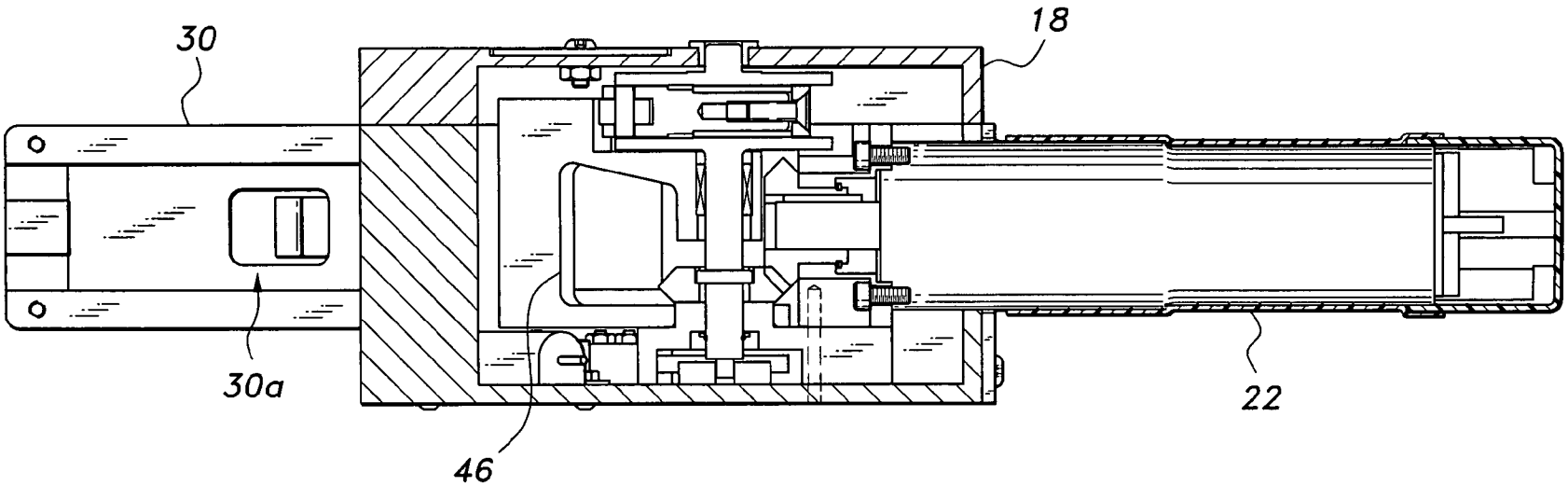
FIG. 4 is a top view in section of an attachment for a stitching tool according to the present invention.

As best seen in FIGS. 2-4, attachment 10 comprises a base member 18 having a handle 20 attached to the top of the base 18. Handle 20 is ergonomically designed to relieve stress when held by a user. A first end 18*a* of base 18 is provided with an opening for receiving an electric motor 22, which is encased in heat shrink tubing. The motor can be either AC or DC thereby being battery powered or, alternatively, powered from an alternating current source via wiring 24. The second end 18*b* of base 18 is provided with an opening 19 for receiving the grasping ends 52, 52*a* of a conventional, manually operated stitching tool 50 therein. End 52*a* is disposed to nest in a lever 46 for reasons as explained below. An arm member 30 extends from end 18*b*. A draw latch 32 is mounted on handle 20 and extends through an opening 30*a* in arm member 30. Draw latch 32 functions to secure grasping end 52 of stitching tool 50 to arm 30. A plurality of conventional electrical components 40 are employed via conventional circuitry to start motor 22 when switch 16 is manipulated. An array of cams, gears and springs, generally indicated at 42, functions to cause lever 46 to pivot vertically when the motor is started.

In use, stitching tool 50 is inserted into opening 19 and grasping end 52 is latched to arm 30. As indicated above, grasping end 52*a* nests in lever 46. Power is applied to motor 22 by actuation of switch 16. The motor functions to pivotally move lever 46 thereby causing grasping end 52*a* to move up and down to perform a powered stitching operation. This arrangement permits a user to stitch without applying the tiring repetitive motion required when the stitching tool is used in a manual mode.

It is to be understood that the present invention is not limited to the embodiment described above, but encompasses any and all embodiments within the scope of the following claims.

I claim:

1. An attachment for a hand tool, comprising:

a base member having a first end and a second end;

a motive power source coupled to the first end of the base member;

an opening disposed in the second end of the base member adapted for receiving a hand tool therein;

an arm member extending from the second end, the arm member having an opening therein;

an ergonomically designed handle mounted on the base member:

a switch mounted on the handle for selectively actuating the power source;

a draw latch disposed on and attached to the handle, a portion of the draw latch extending through the opening in the arm member, the draw latch being adapted for securing the hand tool in the opening and to the arm member; and means in the base member for actuating the hand tool.

2. The attachment for a hand tool according to claim 1, wherein said means for actuating the hand tool includes a lever mounted for pivotal movement on said base member.

3. The attachment for a hand tool according to claim 2, wherein said power source is a DC motor and further including at least one battery connected to said motor.

4. The attachment for a hand tool according to claim 2, wherein said power source is an AC motor and further including wiring connected to said motor, the wiring being adapted for connecting said motor to an AC electrical power source.

* * * * *